US005245303A

United States Patent [19]

Aharonian

[11] Patent Number: 5,245,303

[45] Date of Patent: Sep. 14, 1993

[54] RELAY ACTIVATION ASSEMBLY FOR USE IN AN ELECTROMAGNETIC RELAY

[76] Inventor: Hrair N. Aharonian, 16210 N. Park Dr., #102, Southfield, Mich. 48075

[21] Appl. No.: 970,627

[22] Filed: Nov. 3, 1992

[51] Int. Cl.[5] ..... H01H 51/22

[52] U.S. Cl. ..... 335/78; 335/80; 335/128

[58] Field of Search ..... 335/78–80, 335/128, 124, 121, 270, 274

[56] References Cited

U.S. PATENT DOCUMENTS 3,259,812 7/1966 O'Neil .
3,461,411 8/1969 Hufnagel ..... 335/270
4,177,441 12/1979 Lichtenberger ..... 335/270
4,367,477 1/1983 Koehler ..... 335/80

*Primary Examiner*—Lincoln Donovan

[57] ABSTRACT

A relay activation assembly for use in an electromagnetic relay has a U-shaped core which supports a pair of coils and a spring-biased U-shaped armature nested between the coils. The coils are generally smaller and result in substantial material savings. A pair of flanges extends from the legs of the armature above the coils to provide a flux path between the core and the armature when the coils are energized. Contacts in the relay are actuated by a push rod extending from the armature.

16 Claims, 2 Drawing Sheets

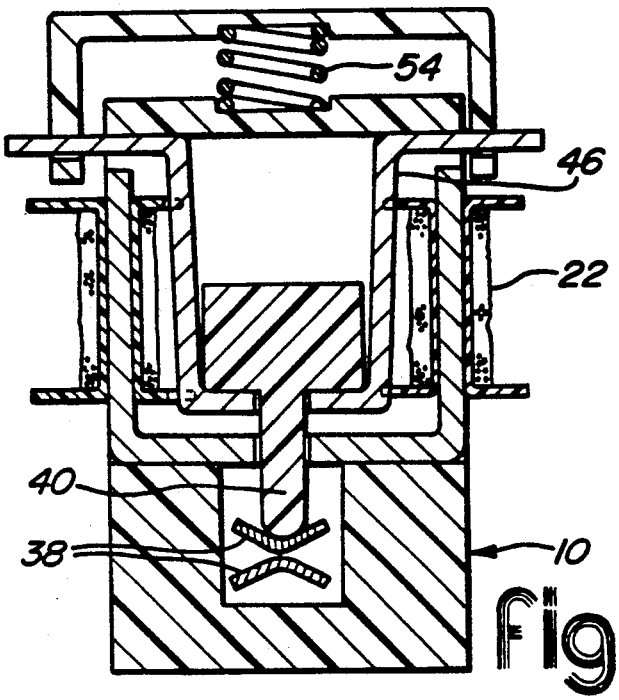
Fig-4
Fig-5
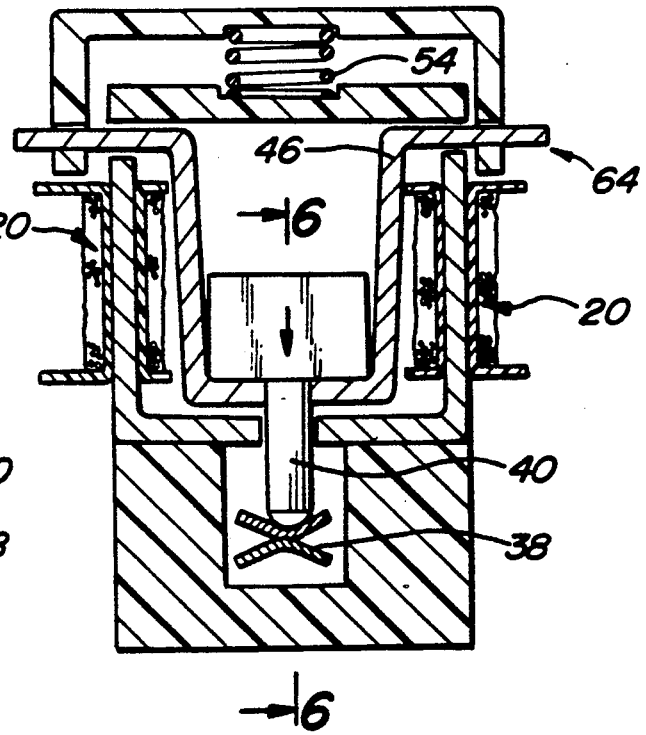
Fig-6
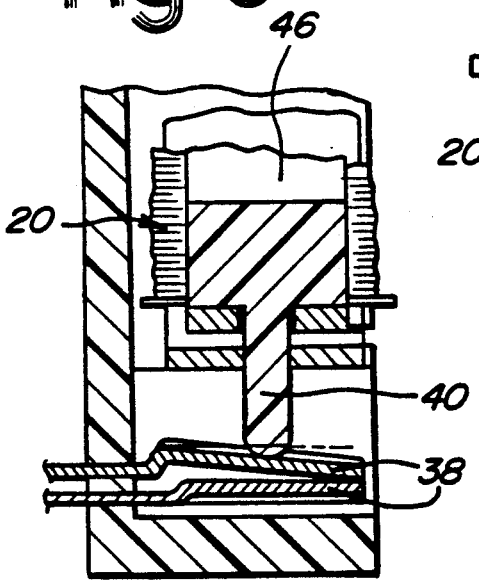

RELAY ACTIVATION ASSEMBLY FOR USE IN AN ELECTROMAGNETIC RELAY

TECHNICAL FIELD

This invention generally relates to electromagnetic relay assemblies and, more particularly, to an electromagnetic relay assembly having a spring biased armature and a pair of coils supported by a unitary core.

BACKGROUND ART

Electromagnetic relays using activation assemblies having spring biased armatures are used in many electrically powered devices. The springs are usually either flat springs or helical springs and are connected directly to the armature. In relays of this type, energization of the coil in the relay generates a magnetic flux through the core of the relay which creates an attractive force on the armature. This force pulls the armature toward the core, actuating the contacts and compressing the spring. When the coil is deenergized, the spring is allowed to return to its uncompressed state, providing the necessary force to bias the armature back to its original position. In practice, however, the magnetic flux produced by the coil is often not efficiently used to attract the armature.

A prior attempt to develop an electromagnetic relay structure which overcomes these problems is described in U.S. Pat. No. 4,177,441 to Lichtenberger. In this structure, a generally U-shaped electromagnetic assembly is provided having a pair of coils mounted onto a U-shaped member. A free-floating armature member is pivotally supported in the U-shaped member and is biased by a flat spring. During operation, the armature teeters about a fulcrum point. Even though this relay structure reduces the amount of flux leakage, the dual coil arrangement requires excessive amounts of copper in its assembly. Furthermore, the structure involves assembly of a large number of parts, adding to the cost and complexity of its manufacture.

DISCLOSURE OF THE INVENTION

It is an object of the present invention to provide an improved electromagnetic relay which minimizes copper wire usage and results in a reduction in weight and the total number of parts.

Another object of the present invention is to provide an electromagnetic relay which is compact in size and readily adaptable for use with multiple contacts.

Accordingly, an improved electromagnetic relay assembly having a U-shaped armature structure and a U-shaped core structure is provided. The core supports two coils wherein the coils are spaced far enough apart so that the armature can be nested between the coils and move freely between the coils. The armature itself has two legs which lie substantially parallel to the longitudinal axes of the coil. The legs and the axes may be disposed at an angle with respect to one another and still considered substantially parallel provided that the coils drive the armature by radially directed flux acting on the legs of the armature. In a preferred version of the invention, a flange extends outwardly from the top of each leg and above each coil support. A push rod for actuating the contacts may also be attached to the bottom portion of the U-shaped armature so that the push rod protrudes below the armature. A housing encloses and secures a portion of the relay assembly wherein the core is rigidly fixed to the housing, leaving the armature free enough to actuate the contacts.

Other aspects of the invention include providing a spring which is preferably attached to the top portion of the housing and is placed between the housing and an elongated member having downwardly extending end portions. A pair of contacts which are secured by the housing are engaged by the push rod wherein the contacts are opened or closed when the armature is lowered. This action also compresses the spring. Conversely, when the armature is released, the spring pushes the elongated member and the armature upward to reverse the status of the contacts.

The above objects and other objects, features, and advantages of the present invention are readily apparent from the following detailed description of the best mode for carrying out the invention when taken in connection with the accompanying drawings.

BRIEF DESCRIPTION OF THE DRAWINGS

FIG. 4 is a cross-sectional view of the relay in the open position;

FIG. 5 is a cross-sectional view of the relay in the closed position; and

FIG. 6 is a cross-sectional view taken along the line 6—6 in FIG. 5.

BEST MODE FOR CARRYING OUT THE INVENTION

Figure 1:
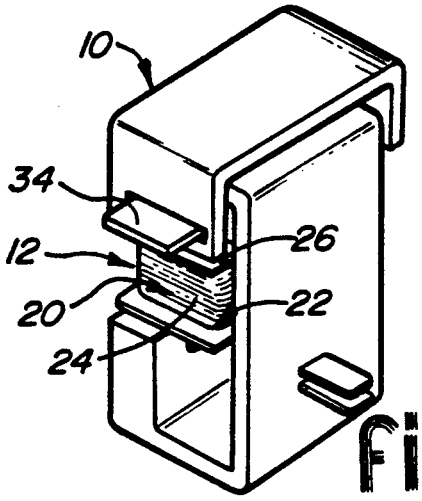
FIG. 1 is a perspective view of the electromagnetic relay assembly.
Figure 2:
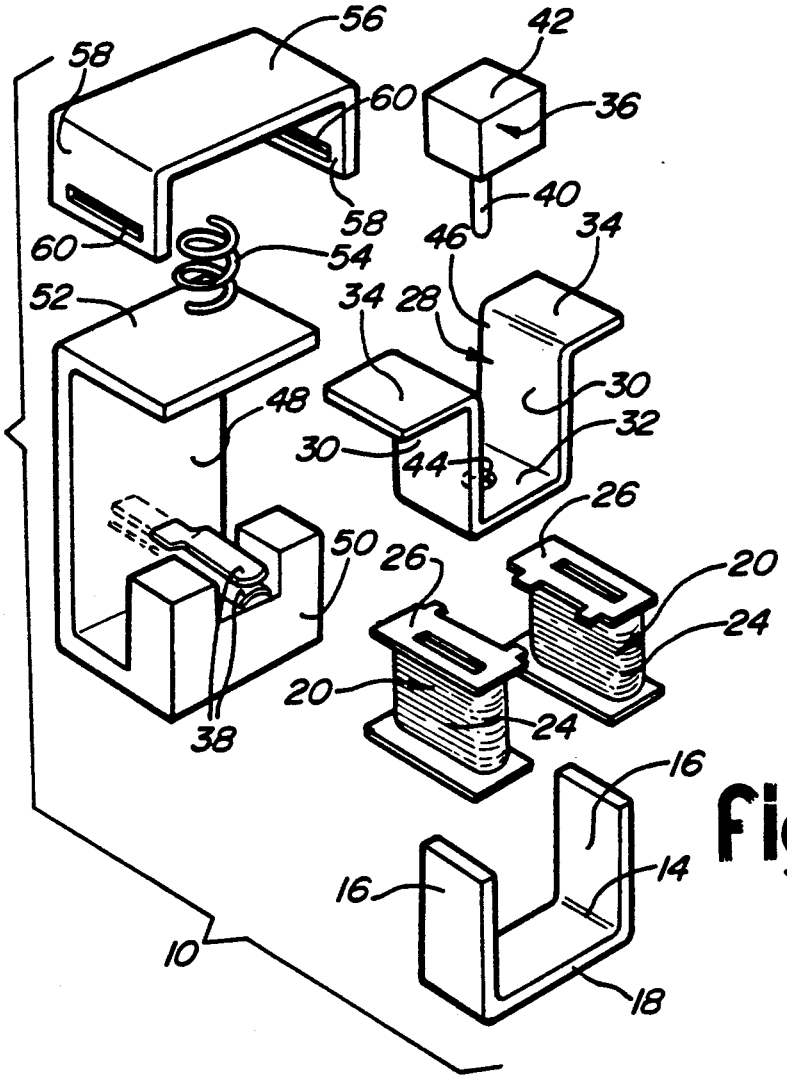
FIG. 2 is an exploded perspective view of the electromagnetic relay assembly.

Referring to FIGS. 1 and 2 of the drawings, an electromagnetic relay 10 having a novel relay activation assembly 12 is shown. A substantially U-shaped core 14 is provided wherein the core 14 comprises a pair of coil supports 16 connected on one end of each by a base portion 18. The core 14 can be easily manufactured from a planar rectangular piece of metal by bending the ends of the piece at an angle to form the coil supports 16 and leaving the middle of the piece flat to form the base portion 18. A coil 20 is placed on each coil support 16 to complete a coil subassembly 22. The coils themselves 20 each comprise a copper winding 24 wrapped around a spool 26 which is preferably made of plastic or another insulating material. The spools 26 can take any shape as long as they are able to fit snugly around the coil supports 16. Preferably, a minimum of copper winding 24 is used to reduce manufacturing costs and material. Additionally, enough space must be left between the coils 20 to allow an armature 28 to fit comfortably.

The armature 28 is placed in between the coils 20. The armature 28, like the core 14, has generally a U-shape. The armature 28 has a pair of legs 30 connected by a spacing portion 32. The legs 30 preferably lie parallel to the longitudinal axes of the coils 20. However, the legs 30 may also lie at an angle with respect to the longitudinal axes of the coils 20 without departing from the scope of the invention. At the top portion of each leg 30, a flange 34 is formed which extends outwardly above the coils 20 and the core supports 16.

An actuator 36 for directly actuating a pair of contacts 38 is attached to the armature. The actuator 36 preferably as illustrated comprises a push rod 40 integrally attached to a small block 42. The push rod 40 and block 42 are both preferably made of an electrically non-conductive material. A hole 44 which is slightly larger in diameter than the push rod 40 is formed in the spacing portion 32 of the armature 28. The actuator 36 is attached to the armature 28 by inserting the push rod 40 through the hole 44 so that the push rod 40 extends through the spacing portion 32 opposite the direction in which the legs 30 extend. The block 42 is then rigidly fixed to the armature 28, forming an armature subassembly 46. Together, the coil subassembly 22 and the armature subassembly 46 form the novel relay activation assembly 12 of the invention.

The armature subassembly 46 is illustrated as used in one style of electromagnetic relay 10. A housing 48 having a generally C-shape partially encloses the assembly 46. The base portion 18 of the core 14 is secured to a support portion 50 of the housing. The housing 48 also has a platform 52 and a helical spring 54 attached to the platform 52. The spring 54 engages an elongated member 56 having downwardly extending end portions 58 with a slot 60 formed in each end portion 58. The slots 60 are large enough to allow the flanges 34 of the armature 28 to fit through them. This connection allows the armature 28 to be biased upwardly by the spring 54 without a direct attachment between the two components.

Figure 3:
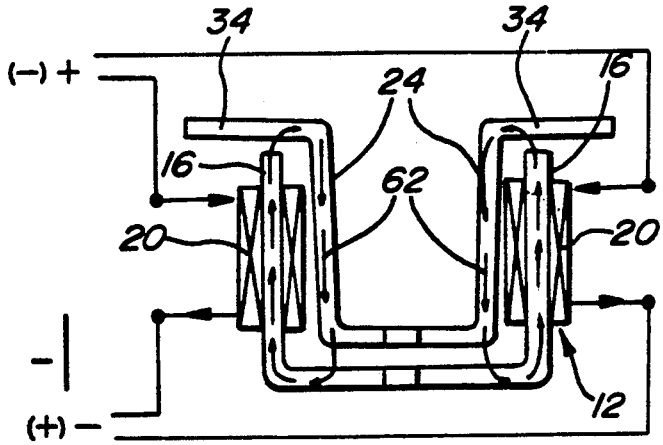
FIG. 3 is a schematic view of the relay activation assembly showing the operative flux lines.

Referring to FIG. 3 of the drawings, flux lines 62 are shown which represent the flux paths generated when the coils 20 are energized. When the coils 20 are energized, each flux path 62 travels through the coil support 16, the flange 34, and the armature leg 24 on each side of the relay activation assembly 12. Each flange 34 and each leg 30 provide a flux path 62 which is adjacent the end of each coil 20.

Referring to FIG. 4 of the drawings, the relay 10 is shown in its deenergized position. The coil subassembly 22 is not receiving any current and the contacts 38 are open. The armature subassembly 46 is biased out of engagement by the spring 54 and the push rod 40 of the actuator does not close the contacts 38.

Referring to FIGS. 5 and 6, when the coils 20 are energized, the armature subassembly 46 is pulled downward by the attractive force generated by the magnetic flux. This compresses the spring 54. Additionally, the push rod 40 presses downwardly onto the contacts 38, urging them together to form an electrical connection. At this point, it is still possible for the armature subassembly 46 to move downward an additional distance 64 to provide extra downward force on the contacts 38 if needed to ensure a firm connection.

While the best mode for carrying out the invention has been described in detail, those familiar with the art to which this invention relates will recognize various alternative designs and embodiments for practicing the invention as defined by the following claims.

What is claimed is:

1. A relay activation assembly for initiating movement in an electromagnetic relay, the assembly comprising:

an armature having a first leg, a second leg, and a spacing portion connecting the first and second legs in a spaced relationship, the first and second legs extending at an angle from the same side of the spacing portion, the armature having an axis;

a first coil having a longitudinal axis substantially parallel to the first leg;

a second coil spaced from the first coil and having a longitudinal axis substantially parallel to the second leg; and a core for supporting first and second coils on a first coil support and a second coil support, respectively, and a base portion connecting the first and second coil supports, the first and second coil supports being substantially parallel to the first and second legs and the base portion being substantially parallel to the spacing portion wherein a first flux path travels through the first leg and the first coil support and a second flux path travels through the second leg and the second coil support, the flux paths generating an attractive force to move the armature along its axis.

2. The relay activation assembly of claim 1 further comprising:

a first flange integrally connected with the first leg; and a second flange integrally connected with the second leg, the first and second flanges extending outwardly over the first and second core supports to provide a flux path adjacent one end of each of the first and second coils.

3. An electromagnetic relay comprising:

a housing;

an armature having a first leg, a second leg, and a spacing portion connecting the first and second legs in a spaced relationship, the first and second legs extending at an angle from the same side of the spacing portion, the armature having an axis;

first and second coil means secured relative to the housing in spaced relationship disposed adjacent said first and second legs for moving the armature along its axis from a first position to a second position;

a spring biasing said armature relative to said first and second coil means for moving the armature from the second position to the first position;

a pair of contacts secured to said housing; and an actuator connected to the spacing portion of the armature for actuating the contacts wherein the contacts are closed when the armature is in one of said positions and the contacts are open when the armature is in the other of said positions.

4. The electromagnetic relay of claim 3 wherein the actuator comprises a push rod extending perpendicularly from the base portion of the armature wherein the push rod pushes the contacts together when the armature is in one of said positions and the contacts are open when the armature is in the other of said positions.

5. The electromagnetic relay of claim 3 wherein the first and second coil means comprises a first coil having a longitudinal axis substantially parallel to the first leg of the armature and a second coil having a longitudinal axis substantially parallel to the second leg of the armature, the first and second coils being held in stationary relationship with respect to the housing.

6. The electromagnetic relay of claim 5 wherein the first coil and the second coil are electrically connected in parallel.

7. The electromagnetic relay of claim 5 wherein the first and second coil means further comprises a core supported by the housing, the core having a first coil support, a second coil support, and a base portion connecting the first and second coil supports, the first and second coil supports being substantially parallel to the first and second legs of the armature, the base portion being substantially parallel to the spacing portion of the armature wherein a first flux path travels through the first leg and the first coil support and a second flux path travels through the second leg and the second coil support.

8. An electromagnetic relay comprising:

a housing;

an armature having a first leg, a second leg, and a spacing portion connecting the first and second legs in a spaced relationship, the first and second legs extending at an angle from the same side of the spacing portion, the armature having an axis;

a first coil having a longitudinal axis substantially parallel to the first leg;

a second coil having a longitudinal axis substantially parallel to the second leg, the first and second coils being held in stationary relationship with respect to the housing;

a core supported by the housing, the core having a first coil support, a second coil support, and a base portion connecting the first and second legs, the first and second coil supports being substantially parallel to the first and second legs and the base portion being substantially parallel to the spacing portion wherein a first flux path travels through the first leg and the first coil support and a second flux path travels through the second leg and the second coil support, the flux paths generating an attractive force to move the armature along its axis from a first position to a second position;

a spring for biasing the armature relative to the housing for movement of the armature from the second position to the first position;

a pair of contacts; and a push rod for actuating the contacts, the push rod extending perpendicularly from the spacing portion of the armature wherein the push rod closes the contacts when the armature is in one of said positions and the push rod releases the contacts and opens the contacts when the armature is in the other of said positions.

9. The electromagnetic relay of claim 8 wherein the first coil and the second coil are electrically connected in parallel.

10. The electromagnetic relay of claim 8 further comprising a first flange integrally connected with the first leg of the armature and a second flange integrally connected with the second leg of the armature, the first and second flanges extending outwardly over the first and second coil supports to provide a flux path adjacent one end of each of the first and second coils.

11. The electromagnetic relay of claim 9 further comprising an elongated member having a first end portion and a second end portion, the first and second end portions extending at an angle from the elongated member and connected to the first and second flanges, the elongated member being connected to the spring to mechanically couple the housing to the armature.

12. An electromagnetic relay comprising:

a housing;

an armature having a first leg, a second leg, and a spacing portion connecting the first and second legs in a spaced relationship, the first and second legs extending at an angle from the same side of the spacing portion;

a first coil having a longitudinal axis substantially parallel to the first leg, said first coil being on the opposite side of the first leg from the second leg;

a second coil having a longitudinal axis substantially parallel to the second leg, said second coil being on the opposite side of the second leg from the first leg, first and second coils being held in stationary relationship with respect to the housing and electrically connected in parallel;

a core supported by the housing, the core having a first coil support, a second coil support, and a base portion connecting the first and second legs, the first and second coil supports being substantially parallel to the first and second legs and the base portion being substantially parallel to the spacing portion wherein a first flux path travels through the first leg and the first coil support and a second flux path travels through the second leg and the second coil support, the flux paths generating an attractive force to move the armature from a first position to a second position;

a first flange integrally connected with the first leg;

a second flange integrally connected with the second leg, the first and second flanges extending outwardly over the first and second core supports to provide a flux path adjacent one end of each of the first and second coils;

an elongated member having a first end portion and a second end portion, the first and second end portions extending at an angle from the elongated member and connected to the first and second flanges;

a spring connected to the elongated member to mechanically couple the housing with the armature;

a pair of contacts; and a push rod extending perpendicularly from the base portion of the armature wherein the push rod pushes the contacts together when the armature is in one of said positions and the contacts are open when the armature is in the other of said positions.

13. The relay activation assembly of claim 2 further comprising a spring biasing said armature relative to said first and second coils for moving the armature from the second position to the first position.

14. A relay activation assembly for initiating movement in an electromagnetic relay, the assembly comprising:

an armature having at least one leg;

a first coil having a longitudinal axis substantially parallel to the armature leg;

a second coil spaced from the first coil and having a longitudinal axis substantially parallel to the armature leg wherein the armature leg lies between the first and second coils;

a core for supporting first and second coils on a first coil support and a second coil support, respectively, the first and second coil supports being substantially parallel to the armature leg wherein a first flux path travels through the armature leg and the first coil support and a second flux path travels through the armature leg and the second coil support, the flux paths generating an attractive force to move the armature from a first position to a second position; and a first flange and a second flange integrally connected with the armature leg, the first and second flanges extending outwardly over the first and second core supports to provide a flux path adjacent one end of each of the first and second coils.

15. A relay activation assembly for initiating movement in an electromagnetic relay, the assembly comprising:

an armature having a first leg and a second leg;

a first coil having a longitudinal axis substantially parallel to the first leg;

a second coil spaced from the first coil and having a longitudinal axis substantially parallel to the second leg wherein the first and second legs lie between the first and second coils; and a core for supporting first and second coils on a first coil support and a second coil support, respectively, the first and second coil supports being substantially parallel to the first and second legs wherein a first flux path travels through the first leg and the first coil support and a second flux path travels through the second leg and the second coil support, the flux paths generating an attractive force to move the armature from a first position to a second position.

16. The relay activation assembly of claim 14 further comprising:

a first flange integrally connected with the first leg; and a second flange integrally connected with the second leg, the first and second flanges extending outwardly over the first and second core supports to provide a flux path adjacent one end of each of the first and second coils.

* * * * *